US008986027B2

(12) United States Patent
Nishimura et al.

(10) Patent No.: US 8,986,027 B2
(45) Date of Patent: Mar. 24, 2015

(54) CONNECTOR

(71) Applicants: Japan Aviation Electronics Industry, Limited, Tokyo (JP); JAE Electronics, Inc., Irvine, CA (US)

(72) Inventors: Takayuki Nishimura, Tokyo (JP); Joe Motojima, Irvine, CA (US)

(73) Assignees: Japan Aviation Electronics Industry, Limited, Tokyo (JP); JAE Electronics Inc., Irvine, CA (US)

( * ) Notice: Subject to any disclaimer, the term of this patent is extended or adjusted under 35 U.S.C. 154(b) by 131 days.

(21) Appl. No.: 13/665,419

(22) Filed: Oct. 31, 2012

(65) Prior Publication Data

US 2014/0120780 A1 May 1, 2014

(51) Int. Cl.

| | |
|---|---|
| ***H01R 13/53*** | (2006.01) |
| ***H01R 12/70*** | (2011.01) |
| ***H01R 12/71*** | (2011.01) |
| ***H01R 43/24*** | (2006.01) |

(52) U.S. Cl.

CPC ..... *H01R 12/707* (2013.01); *H01R 12/716* (2013.01); *H01R 43/24* (2013.01)

USPC ..... 439/181; 439/74

(58) Field of Classification Search

CPC ..... H01R 23/02

USPC ..... 439/181, 180, 101–103, 607.1, 660, 74

See application file for complete search history.

(56) References Cited

U.S. PATENT DOCUMENTS

| | | | | |
|---|---|---|---|---|
| 5,674,083 | A * | 10/1997 | Whiteman et al. | 439/181 |
| 6,726,492 | B1 * | 4/2004 | Yu | 439/108 |
| 7,059,908 | B2 * | 6/2006 | Yamaguchi | 439/607.17 |
| 7,074,085 | B2 * | 7/2006 | Chen | 439/607.36 |
| 7,789,673 | B2 * | 9/2010 | Lee et al. | 439/74 |
| 2008/0139057 | A1 | 6/2008 | Fukuchi | |

FOREIGN PATENT DOCUMENTS

| | | | |
|---|---|---|---|
| JP | 2000-173683 | A | 6/2000 |
| JP | 2008-146870 | A | 6/2008 |
| JP | 2012-033439 | A | 2/2012 |

* cited by examiner

*Primary Examiner* — Phuongchi T Nguyen

(74) *Attorney, Agent, or Firm* — Holtz, Holtz, Goodman & Chick PC

(57) ABSTRACT

A connector includes a plurality of contacts, a housing made of a predetermined material and a reinforcement member. The housing holds the contacts. The housing includes a bottom portion extending in a longitudinal direction of the connector. The reinforcement member is, at least in part, embedded in the bottom portion of the housing via insert-molding. The reinforcement member has a rib portion extending in the longitudinal direction. The rib portion has a reversed U- or V-shape cross-section and is filled with the predetermined material of the housing.

7 Claims, 10 Drawing Sheets

CONNECTOR

BACKGROUND OF THE INVENTION

This invention relates to a connector which includes a reinforcement member.

JP 2012-33439 A discloses a connector which includes a housing and a reinforcement member attached to the housing. The housing is made of synthetic resin. The reinforcement member is made of metal and extends in a longitudinal direction of the connector.

JP 2000-173683 A discloses a connector which includes a housing and a reinforcement member embedded in the housing via insert-molding. The housing is made of insulator. The reinforcement member is made of metal and extends in a longitudinal direction of the connector.

There is a need for embedding a reinforcement member in a housing via insert-molding so as to make a connector's profile low. However, the reinforcement member of JP 2012-33439A is not suitable for insert-molding. The reinforcement member of JP 2000-173683A might not be embedded in the housing via insert-molding when the profile of the connector becomes lower.

SUMMARY OF THE INVENTION

It is an object of the present invention to provide a connector having a structure more suitable for embedding, at least in part, a reinforcement member in a housing via insert-molding.

One aspect of the present invention provides a connector which comprises a plurality of contacts, a housing and a reinforcement member. The housing is made of a predetermined material and holds the contacts. The housing includes a bottom portion extending in a longitudinal direction of the connector. The reinforcement member is, at least in part, embedded in the bottom portion of the housing via insert-molding. The reinforcement member has a rib portion extending in the longitudinal direction. The rib portion has a reversed U- or V-shape cross-section. The rib portion is filled with the predetermined material of the housing.

The reinforcement member has the rib portion of the reversed U-like or V-like shape cross-section, and the predetermined material such as resin of the housing is filled within the rib portion. Because of the structural relation between the reinforcement member and the housing, a large contact area between the housing and the rib portion of the reinforcement member is ensured even if the reinforcement member is embedded in the bottom portion of the housing at shallow depths. Therefore, smooth movement of the predetermined material upon insert-molding is ensured while the reinforcement member is secured to the housing.

An appreciation of the objectives of the present invention and a more complete understanding of its structure may be had by studying the following description of the preferred embodiment and by referring to the accompanying drawings.

Figure 1:
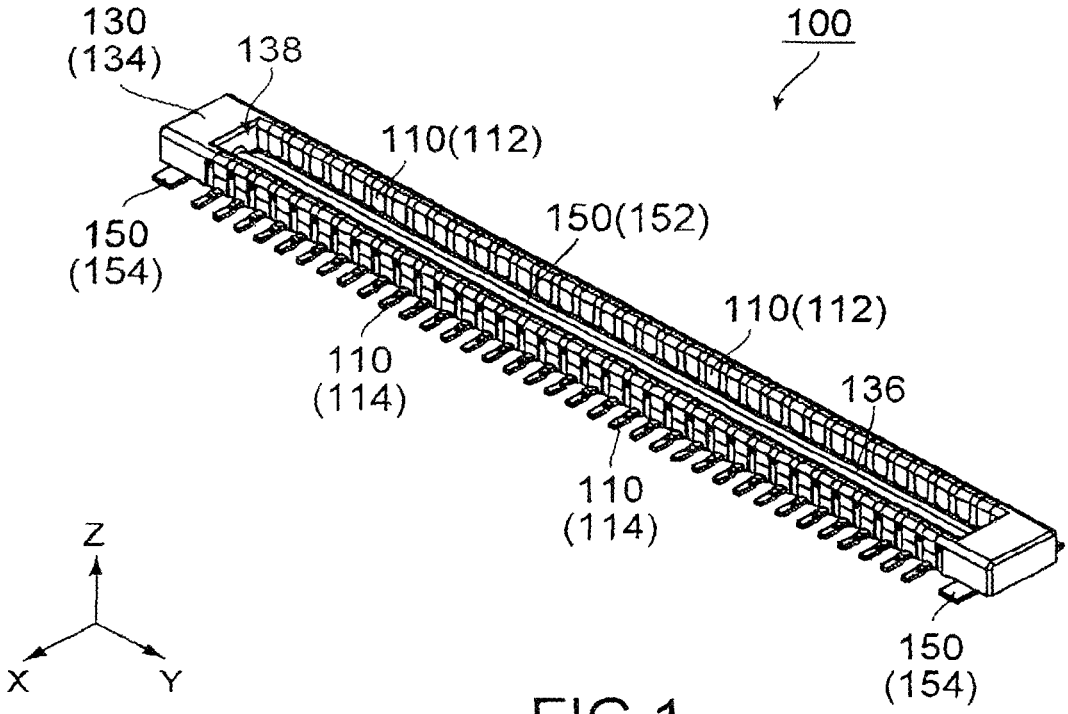
FIG. 1 is a perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
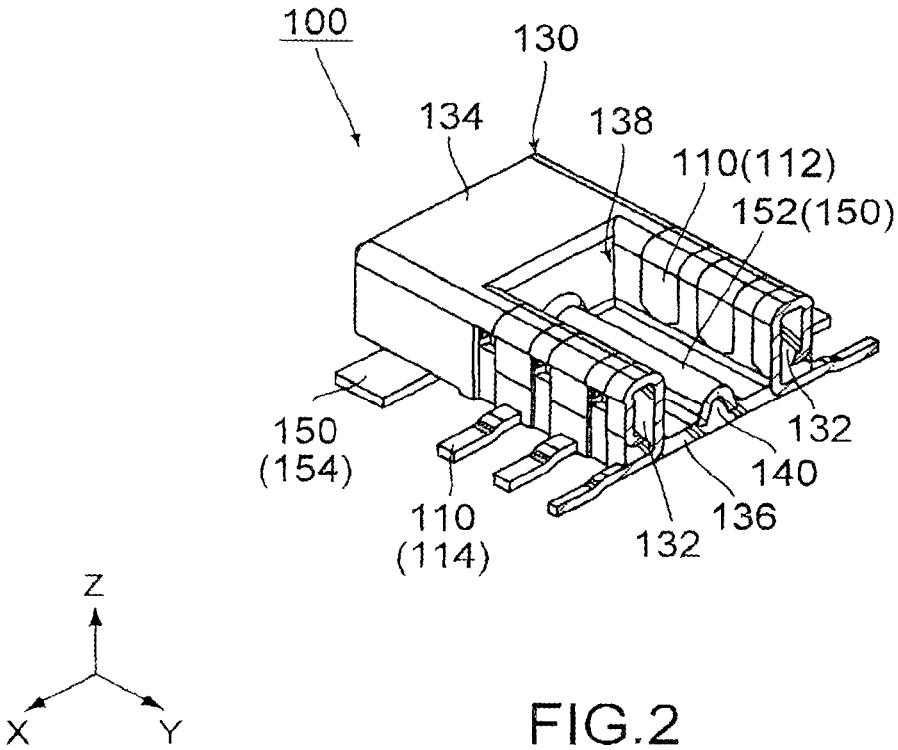
FIG. 2 is a cut-away, cross-sectional perspective view showing the connector of FIG. 1.
Figure 3:
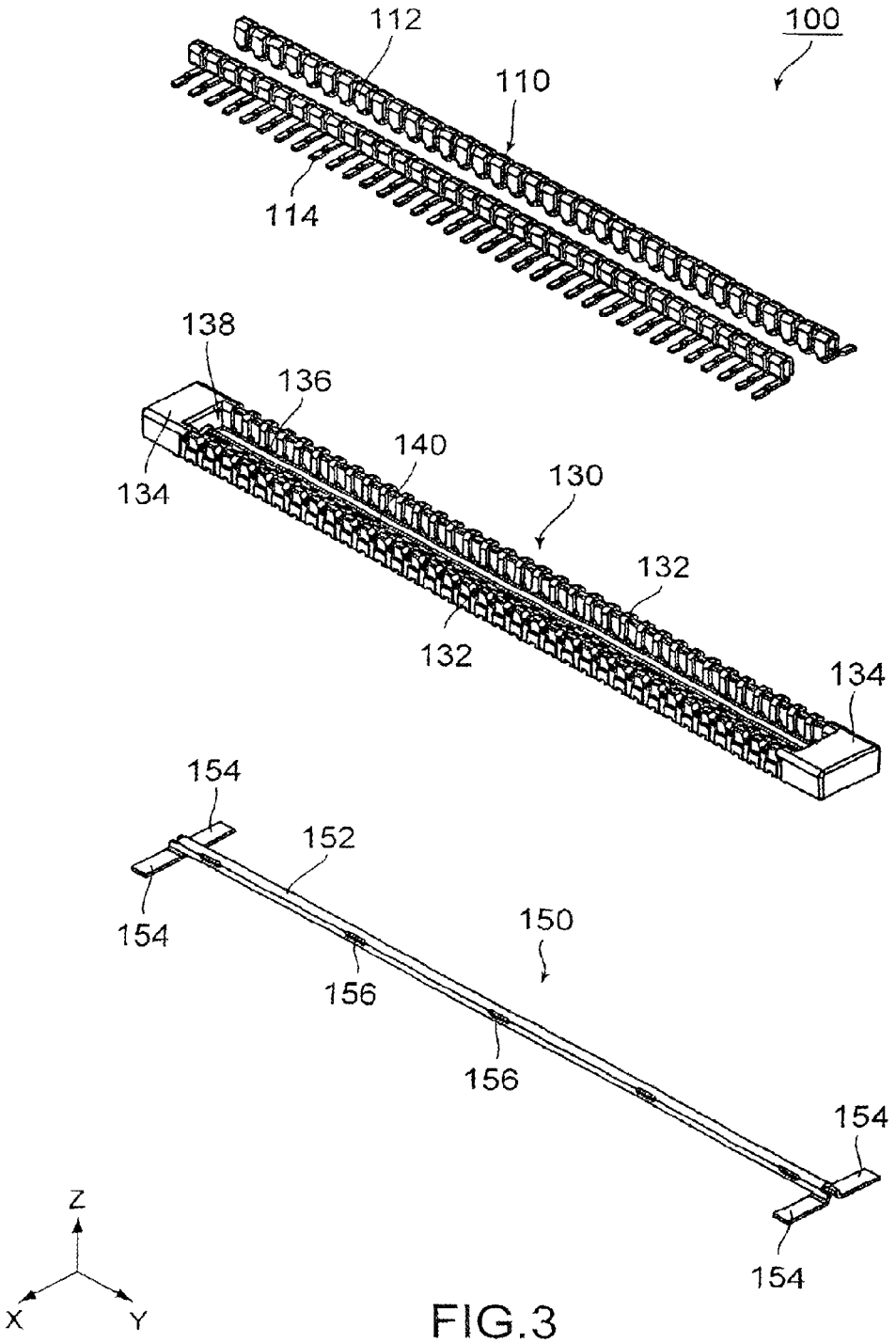
FIG. 3 is an exploded, perspective view showing the connector of FIG. 1.
Figure 4:
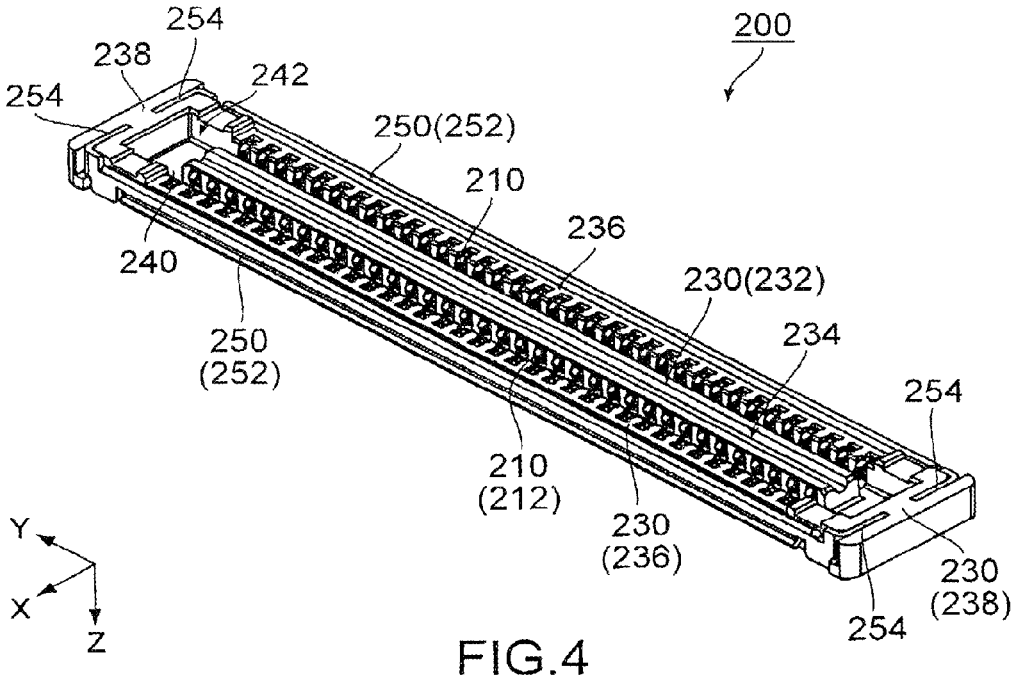
FIG. 4 is a perspective view showing a mating connector mateable with the connector of FIG. 1.
Figure 5:
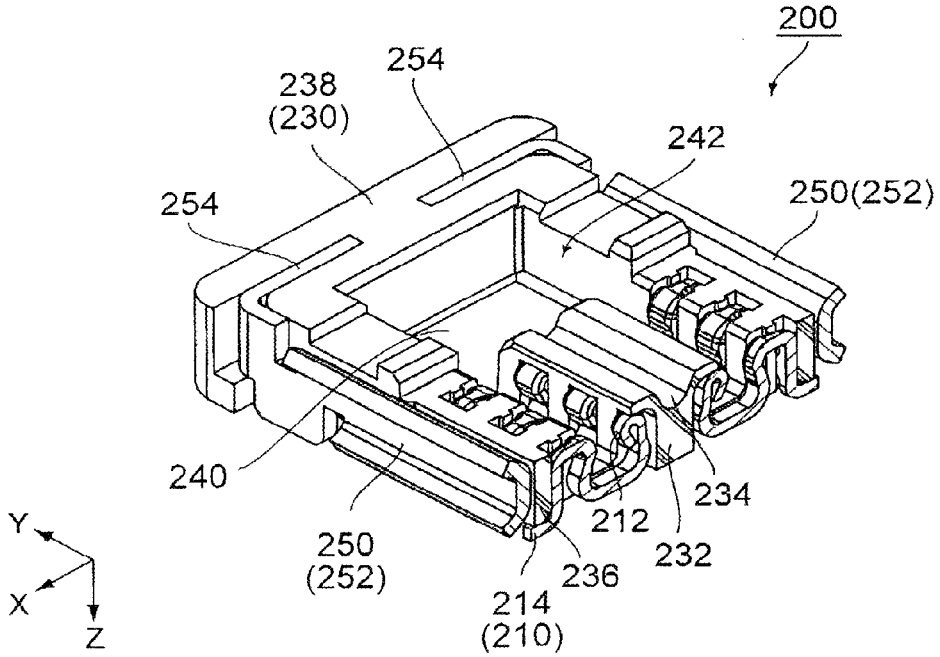
FIG. 5 is a cut-away, cross-sectional perspective view showing the mating connector of FIG. 4
Figure 6:
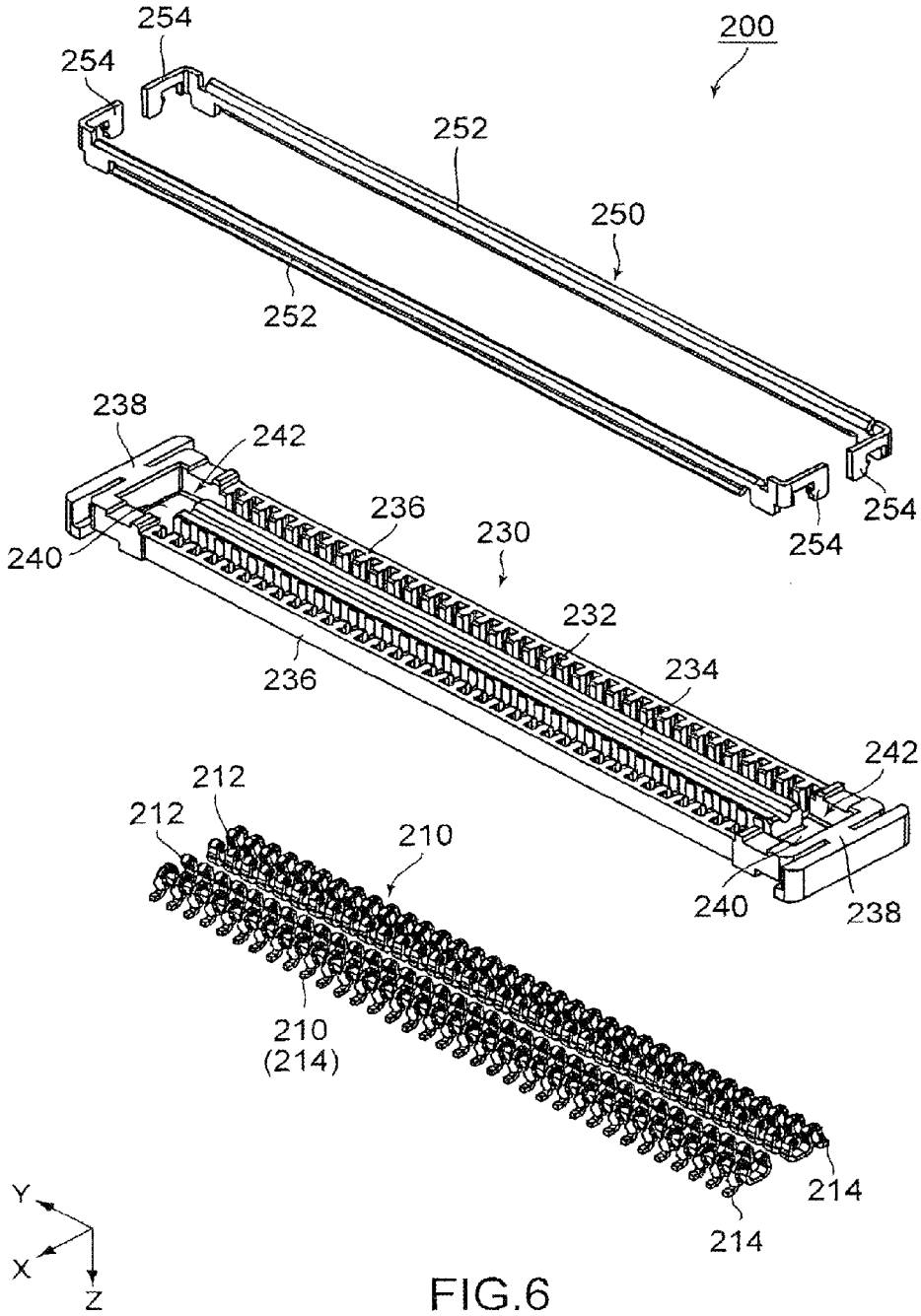
FIG. 6 is an exploded, perspective view showing the mating connector of FIG. 4.

With reference to FIGS. 1 to 3, a connector 100 according to a first embodiment of the present invention is a plug connector mountable on a circuit board (not shown). With reference to FIGS. 4 to 6, a mating connector 200 according to the first embodiment is a receptacle connector mountable on another circuit board (not shown). The connector 100 is mateable with and detachable from the mating connector 200 along a Z-direction, which is a height direction of the connector 100.

As shown in FIG. 3, the connector 100 comprises a plurality of contacts 110, a housing 130 holding the contacts 110 and a reinforcement member 150 reinforcing the housing 130. The contacts 110 and the reinforcement member 150 are made of metal. The housing 130 is made of insulating material, especially, resin. The contacts 110 and the reinforcement member 150 are partially embedded in the housing 130 via insert-molding.

Each contact 110 has a contact portion 112 and a terminal portion 114. The contact portion 112 is used to electrically connect between the connector 100 and the mating connector 200. The terminal portion 114 is surface-mounted on a circuit board (not shown) when the connector 100 is mounted on the circuit board.

The reinforcement member 150 is formed by stamping a base material plate out, followed by folding the stamped base material plate. The reinforcement member 150 has a rib portion 152 and holddown portions 154. The rib portion 152 extends in a Y-direction, which is a longitudinal direction of the connector 100. The rib portion 152 has a reversed U- or V-shape cross-section in an XZ plane perpendicular to the Y-direction. In other words, the rib portion 152 has a half-pipe like shape, a reversed ditch like shape or a reversed trench like shape. Each holddown portion 154 is positioned at an end of the rib portion 152 in the Y-direction and extends in an X-direction. The holddown portion 154 is fixed to a circuit board (not shown) when the connector 100 is mounted on the circuit board.

As shown in FIGS. 2 and 3, the housing 130 has two sidewall portions 132, two block portions 134, and a bottom portion 136. The sidewall portions 132 face each other in the X-direction. Each block portion 134 connects ends of the sidewall portions 132. The sidewall portions 132 and the block portions 134 form a frame-like shape. The bottom portion 136 is provided at a lower end of the frame-like shape. The sidewall portions 132, the block portions 134 and the bottom portion 136 form a receiving portion 138 which partially receives the mating connector 200.

As best shown in FIG. 2, the contacts 110 are partially embedded in the sidewall portions 131 The contact portions 112 of the contacts 110 are exposed in the receiving portion 138.

The reinforcement member 150 is partially embedded in the bottom portion 136 and the block portions 134. The rib portion 152 is partially embedded into the bottom portion 136 of the housing 130. In the 7-direction, the part of the rib portion 152, which is embedded in the bottom portion 136, has a size equal or smaller than a thickness of the base material plate of the reinforcement member 150. Therefore, even if the bottom portion 136 is thinner, resin movement is not obstructed by the reinforcement member 150 upon insert-molding. The other part of the rib portion 152, which is not embedded in the bottom portion 136, protrudes from the bottom portion 136 within the receiving portion 138. The rib portion 152 is filled with the resin, i.e., the material of the housing 130 so that a filled portion 140 is formed between the bottom portion 136 and the rib portion 152. Thus, a large contact area between the rib portion 152 of the reinforcement member 150 and the filled portion 140 of the housing 130 can be obtained.

Figure 14:
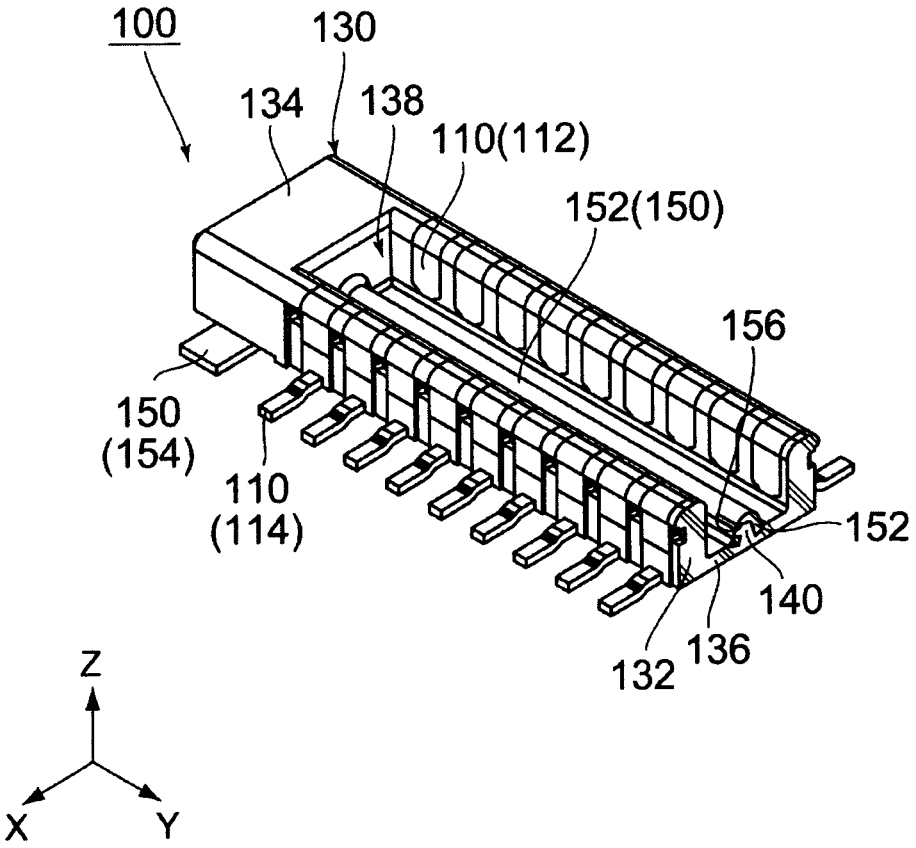
FIG. 14 is a cut-away, cross-sectional perspective view showing the connector of FIG. 1.

As shown in FIG. 3, the rib portion 152 is formed with through-holes 156. Each through-hole 156 connects between the inside and the outside of the rib portion 152. As apparent from FIGS. 1 to 3, the through-holes 156 are filled with the resin, i.e., the material of the housing 130. In other words, the filled portion 140 are formed with protrusions, which are fit with the through-holes 156, respectively. See also FIG. 14. Thus, the reinforcement member 150 is securely fixed to the housing 130.

As shown in FIG. 6, the mating connector 200 comprises a plurality of mating contacts 210, a mating housing 230 and mating reinforcement members 250. The mating housing 230 holds the mating contacts 210. The mating reinforcement members 250 reinforce the mating housing 230 and electrically shield the mating contacts 210. The mating contacts 210 and the mating reinforcement members 250 are made of metal. The mating housing 230 is made of insulator, especially, resin. The mating contacts 210 and the mating reinforcement members 250 are press-fit into and held by the mating housing 230 in this embodiment.

Each mating contact 210 has a contact portion 212 and a terminal portion 214. When the connector 100 is mated with the mating connector 200, the contact portion 212 is physically and electrically connected to the contact portion 112 of the corresponding contact 110. The terminal portion 214 is surface-mounted on a circuit board (not shown) when the mating connector 200 is mounted on the circuit board.

As shown in FIGS. 4 to 6, the mating housing 230 has a center protrusion portion 232, facing wall portions 236, end portions 238 and a bottom portion 240. The center protrusion portion 232 extends in the Y-direction. The center protrusion portion 232 is received by the receiving portion 138 of the housing 130 when the connector 100 is mated with the mating connector 200. The center protrusion portion 232 is formed with a ditch 234 which is depressed in the Z-direction and extends in the Y-direction. The ditch 234 receives the rib portion 152 when the center protrusion portion 232 is received by the receiving portion 138. Each facing wall portion 236 faces the center protrusion portion 232 in the X-direction while the center protrusion portion 232 is positioned between the facing wall portions 236 in the X-direction. Each end portion 238 connects ends of the facing wall portions 236. The facing wall portions 236 and the end portions 238 form a frame-like shape, which surrounds the center protrusion portion 232. The bottom portion 240 is provided at a lower end of the frame-like shape. The facing wall portions 236, the end portions 238 and the bottom portion 240 form an accommodation portion 242 around the center protrusion portion 232. The accommodation portion 242 partially accommodates the sidewall portions 132 and the block portions 134 when the connector 100 is mated with the mating connector 200.

As best shown in FIG. 5, the mating contacts 210 are inserted and press-fit in the mating housing 230 from the bottom portion 240 thereof. The mating contacts 210 are held by the mating housing 230 so that the contact portions 212 of the mating contacts 210 are exposed in the accommodation portion 242.

As shown in FIG. 6, Each of the mating reinforcement members 250 is formed by stamping a base material plate out, followed by folding the stamped base material plate. Each mating reinforcement member 250 has a main portion 252 and held portions 254. The main portion 252 extends in the Y-direction. As shown in FIG. 5, the main portion 252 is curved so as to have a C-shape cross-section in the XZ plane. The held portions 254 are press-fit into the end portions 238. Thus, the main portions 252 cover the outsides of the facing wall portions 236 of the mating housing 230, respectively, as shown in FIGS. 4 and 5. Each main portion 252 is tolerant of a stress along the Z-direction because it is curved as mentioned above.

Figure 7:
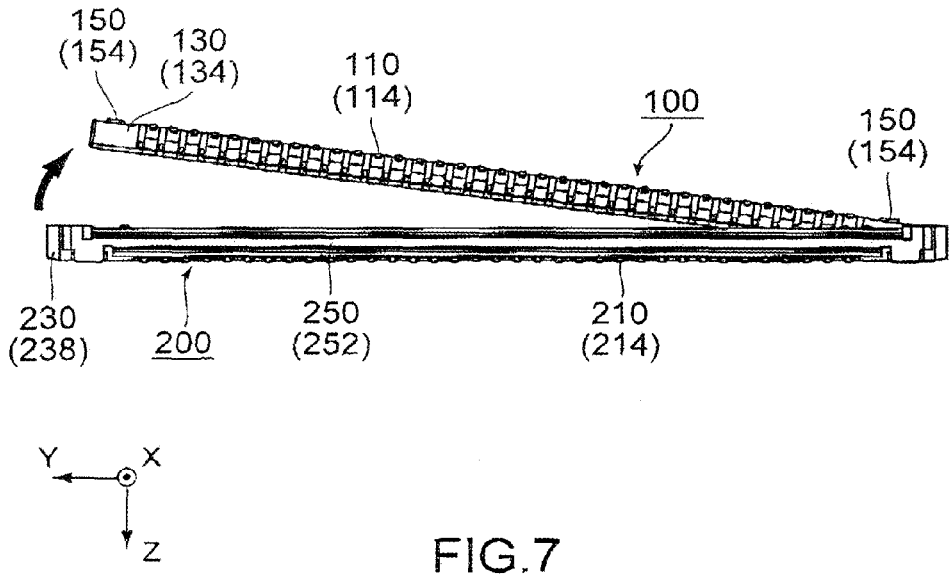
FIG. 7 is a side view showing a detachment process of the connector of FIG. 1 from the mating connector of FIG. 4.

Upon the detachment process, sometimes only one end of the connector 100 is detached from the mating connector 200, as shown in FIG. 7. Upon such detachment, the housing 130 and the mating housing 230 are stressed so as to be curved. However, according to the present embodiment, the reinforcement member 150 and the mating reinforcement members 250 reinforce the housing 130 and the mating housing 230, respectively, so that the housing 130 and the mating housing 230 can be prevented from being broken. In addition, because the large contact area between the reinforcement member 150 and the housing 130 is ensured, the insert-molded reinforcement member 150 can be secured to the housing 130 and can reinforce the housing 130 properly even if the housing 130 becomes lower.

Second Embodiment

With reference to FIGS. 8 to 13, a connector 100A and a mating connector 200A according to a second embodiment of the present invention are modifications of the above-described first embodiment. In FIGS. 8 to 13, components similar to those of FIGS. 1 to 6 are labeled with reference numerals similar to those of FIGS. 1 to 6, and explanation thereabout will be omitted for the sake of clarity of the description. Explanation will be hereinafter directed to differences between the first and the second embodiments.

Figure 8:
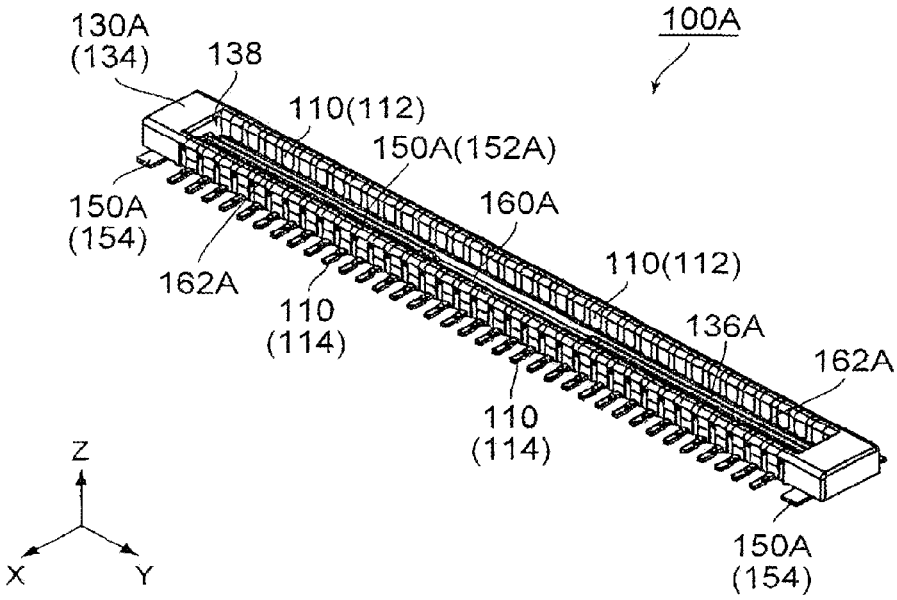
FIG. 8 is a perspective view showing a connector according to a second embodiment of the present invention.
Figure 9:
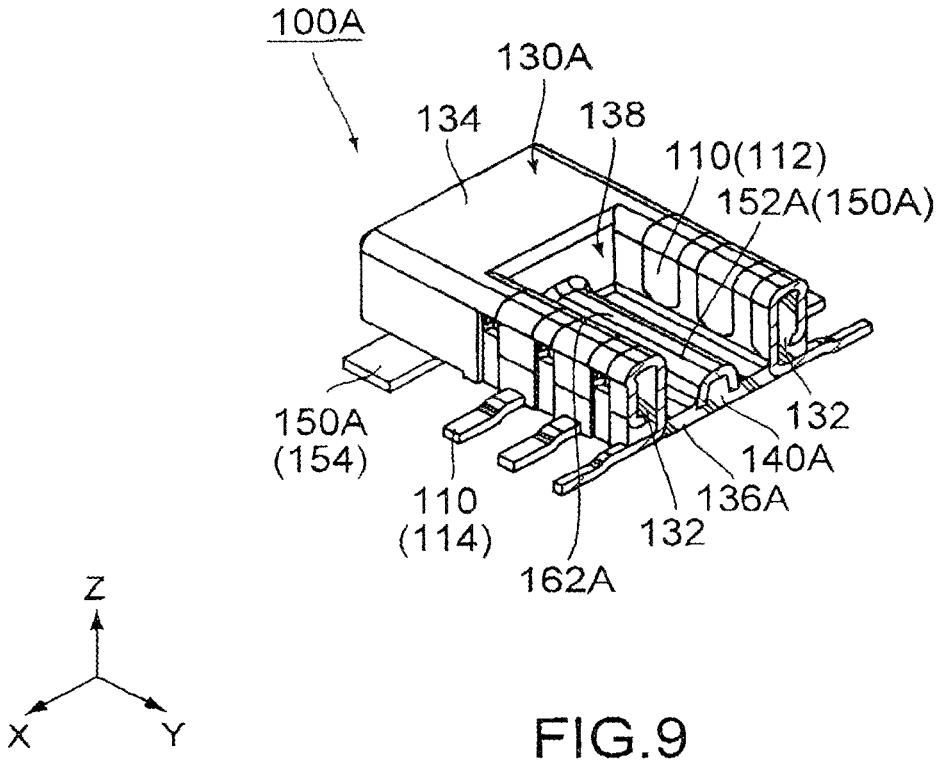
FIG. 9 is a cut-away, cross-sectional perspective view showing the connector of FIG. 8.
Figure 10:
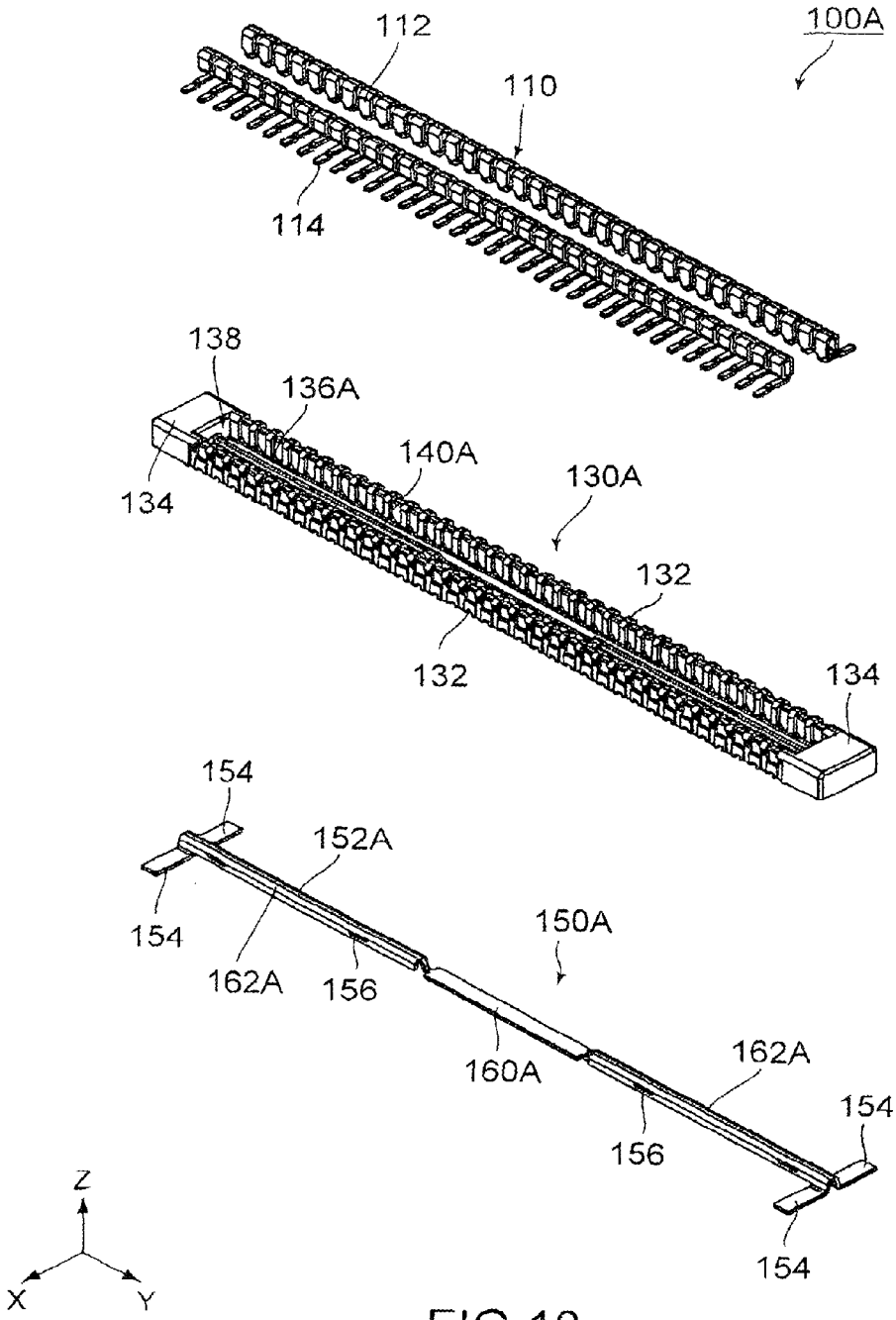
FIG. 10 is an exploded, perspective view showing the connector of FIG. 8.

As shown in FIGS. 8 and 10, a reinforcement member 150A has a rib portion 152A which includes a flat plate portion 160A and two reversed ditch portions 162A. The flat plate portion 160A is used and sucked by a nozzle of a vacuum carrier section of an automated placement machine (not shown). The flat plate portion 160A is positioned between the reversed ditch portions 162A. As apparent from FIG. 9, each of the reversed ditch portions 162A has a reversed U- or V-shape cross-section in the XZ plane, like as the rib portion 152 of the first embodiment.

As apparent from FIGS. 9 and 10, a housing 130A includes a bottom portion 136A and two filled portions 140A. As shown in FIG. 8, the flat plate portion 160A is embedded in the bottom portion 136A so that one surface of the flat plate portion 160A is exposed in the receiving portion 138. The reversed ditch portions 162A are partially embedded into the bottom portion 136A and are filled with the filled portions 140A, respectively. Because of large contact areas between the filled portions 140A and the reversed ditch portions 162A, the reinforcement member 150A is secured to the housing 130A, similar to the first embodiment.

With reference to FIGS. 8 and 10, a size of the flat plate portion 160A is about one fourth of a total size of the rib portion 152A. If the size of the flat plate portion 160A is smaller than one fifth of the total size of the rib portion 152A, the vacuum carrier section might not use a nozzle of suitable or normal diameter for suction of the flat plate portion 160A. If the size of the flat plate portion 160A is larger than one half of the total size of the rib portion 152A, the flat plate portion 160A obstructs the movement of the resin upon the insert-molding. Therefore, it is preferable that the size of the flat plate portion 160A is one fifth to one half of the total size of the rib portion 152A.

Figure 11:
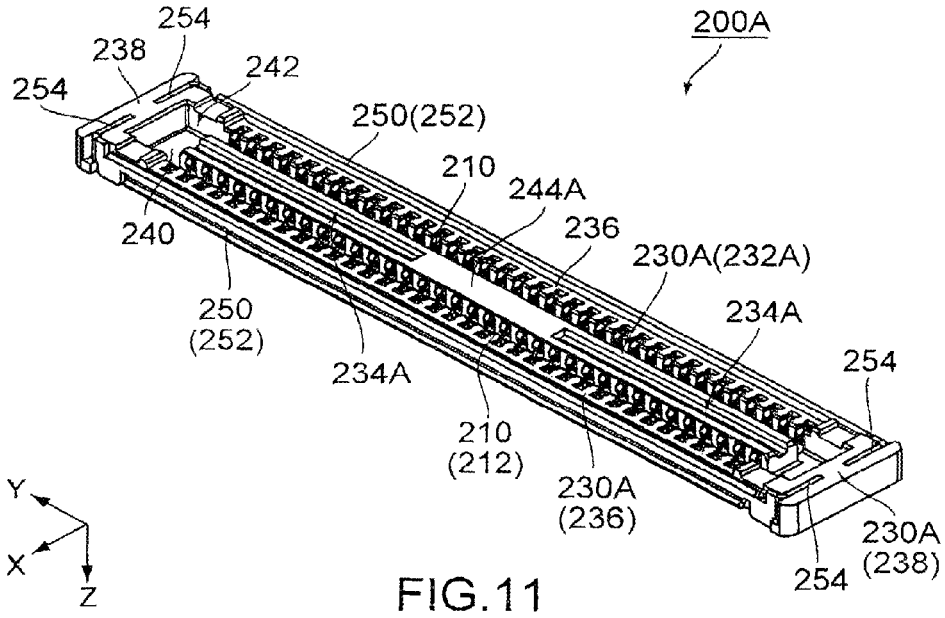
FIG. 11 is a perspective view showing a mating connector mateable with the connector of FIG. 8.
Figure 12:
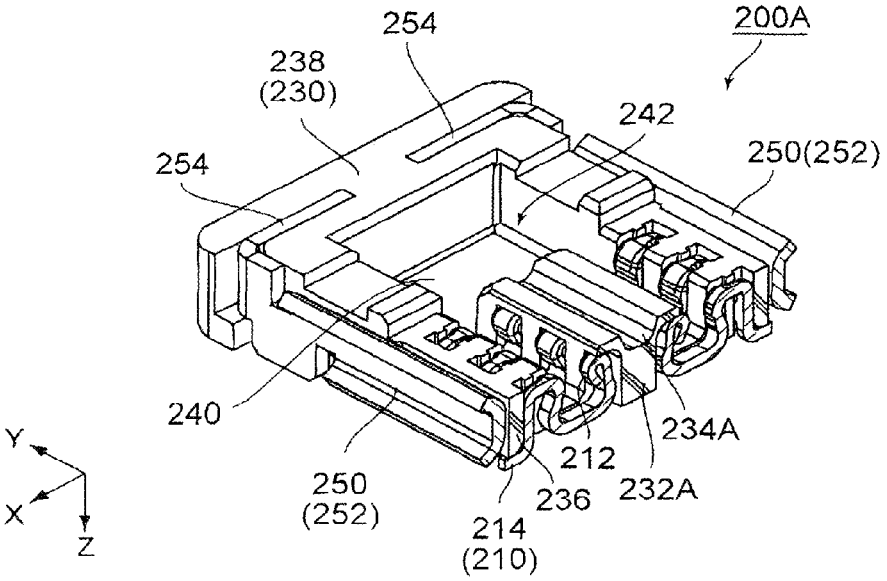
FIG. 12 is a cut-away, cross-sectional perspective view showing the mating connector of FIG. 11
Figure 13:
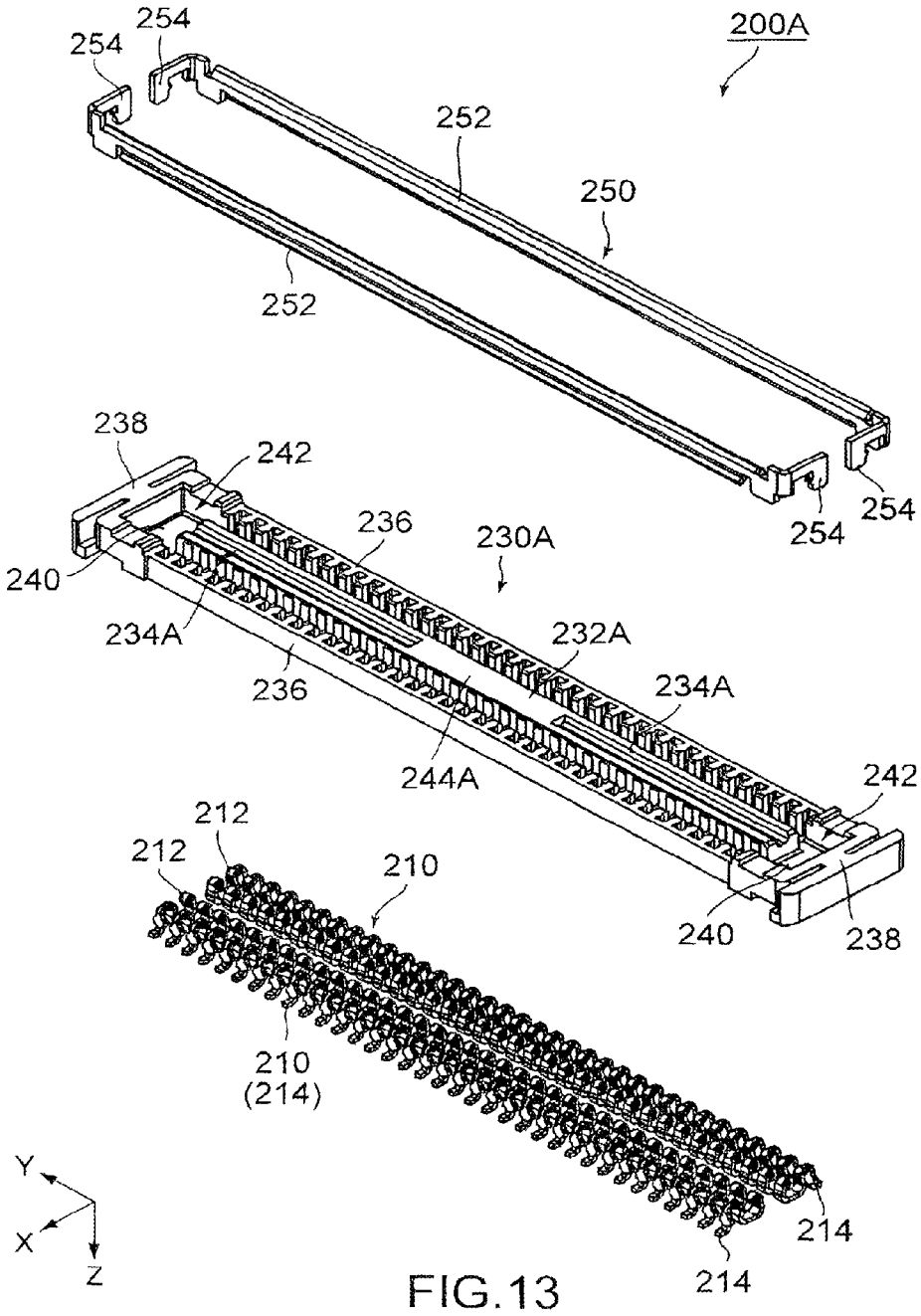
FIG. 13 is an exploded, perspective view showing the mating connector of FIG. 11.

With reference to FIGS. 11 to FIG. 13, a mating housing 230A includes a center protrusion portion 232A. The center protrusion portion 232A is formed with two ditches 234A, each of which is depressed in the Z-direction and extends in the Y-direction. The ditches 234A receive the reversed ditch portions 162A, respectively, when the connector 100A is mated with the mating connector 200A so that the center protrusion portion 232A is received by the receiving portion 138. Between the ditches 234A in the Y-direction, a flat surface portion 244A is provided in this embodiment. The flat surface portion 244A is positioned at a position corresponding to the flat plate portion 160A under the mating state where the connector 100A and the mating connector 200A are mated with each other. In this embodiment, the flat surface portion 244A is in contact with the flat plate portion 160A when the connector 100A is mated with the mating connector 200A. The flat surface portion 244A and the flat plate portion 160A may be not in contact with each other with a space left therebetween.

Upon the automated placement process of the mating connector 200 according to the first embodiment, a tape and so on is put on a fitting portion to be used as a surface sucked by a nozzle of a vacuum carrier section because the whole center protrusion portion 232 is formed with the ditch 234. On the other hand, the center protrusion portion 232A of the mating connector 200A according to the second embodiment is formed with the flat surface portion 244A, which is used as a surface sucked by a nozzle of a vacuum carrier section, similar to the flat plate portion 160A of the connector 100A. Therefore, the second embodiment can reduce the number of processes in comparison with the first embodiment.

Although the connector 100, 100A is a plug connector while the mating connector 200, 200A is a receptacle connector in the above-described embodiment, the connector 100, 100A may be a receptacle connector while the mating connector 200, 200A may be a receptacle connector. The mating reinforcement member 250 may be embedded, at least in part, in the mating housing 230, 230A via insert-molding.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a plurality of contacts;

a housing made of a predetermined material and holding the contacts, the housing including a bottom portion extending in a longitudinal direction of the connector; and a reinforcement member which is, at least in part, embedded in the bottom portion of the housing via insert-molding, the reinforcement member having a rib portion extending in the longitudinal direction, the rib portion having a reversed U- or V-shape in cross-section, and the rib portion being filled with the predetermined material of the housing.

2. The connector as recited in claim 1, wherein the reinforcement member portion is a stamped and folded member, wherein the rib portion is partially embedded into the bottom portion of the housing, and wherein a size of the embedded part of the rib portion in a height direction perpendicular to the longitudinal direction is equal to or smaller than a thickness of the base material plate.

3. The connector as recited in claim 1, wherein the rib portion is formed with at least one through-hole, and the through-hole is filled with the predetermined material.

4. The connector as recited in claim 1, wherein:

the connector is mateable with a mating connector;

the housing has a receiving portion which partially receives the mating connector when the connector is mated with the mating connector;

a part of the rib portion is embedded into the bottom portion of the housing; and another part of the rib portion, which is not embedded in the bottom portion of the housing, protrudes from the bottom portion of the housing within the receiving portion.

5. The connector as recited in claim 1, wherein the rib portion includes a flat plate portion.

6. The connector as recited in claim 5, wherein, in the longitudinal direction, a size of the flat plate portion is one fifth to one half of a total size of the rib portion.

7. The connector as recited in claim 5, the connector being mateable with a mating connector that includes a flat surface portion which is positioned at a position corresponding to the flat plate portion in a state in which the mating connector is mated with the connector.

* * * * *

UNITED STATES PATENT AND TRADEMARK OFFICE

CERTIFICATE OF CORRECTION

PATENT NO. : 8,986,027 B2
APPLICATION NO. : 13/665419
DATED : March 24, 2015
INVENTOR(S) : Takayuki Nishimura et al.

It is certified that error appears in the above-identified patent and that said Letters Patent is hereby corrected as shown below:

In the Specification

Column 2, Line 16, delete "FIG. 11" and insert --FIG. 11.--

Column 3, Line 16, delete "portions 131" and insert --portions 132--

Column 3, Line 22, delete "7- direction," and insert --Z- direction,--

Signed and Sealed this
Third Day of November, 2015

Michelle K. Lee

Michelle K. Lee
*Director of the United States Patent and Trademark Office*